United States Patent [19]

Gilliams et al.

[11] B 4,014,856

[45] Mar. 29, 1977

[54] LIQUID ELECTROPHOTOGRAPHIC DEVELOPERS

[75] Inventors: Yvan Karel Gilliams, Berchem; Jozef Leonard Van Engeland, St. Katelijne-Waver; Noel Jozef De Volder, Edegem, all of Belgium

[73] Assignee: AGFA-GEVAERT, N.V., Mortsel, Belgium

[22] Filed: July 5, 1973

[21] Appl. No.: 376,749

[44] Published under the second Trial Voluntary Protest Program on March 30, 1976 as document No. B 376,749.

[30] Foreign Application Priority Data

July 12, 1972 United Kingdom ..... 32656/72

[52] U.S. Cl. ..... 252/62.1 L; 96/1.3

[51] Int. Cl.[2] ..... G03G 9/00

[58] Field of Search ..... 252/62.1 L; 96/1.3

[56] References Cited

UNITED STATES PATENTS

| | | | |
|---|---|---|---|
| 2,877,133 | 3/1959 | Mayer | 252/62.1 L X |
| 3,084,043 | 5/1963 | Gundlach | 252/62.1 L X |
| 3,301,675 | 1/1967 | Fauser et al. | 252/62.1 L X |
| 3,383,209 | 5/1968 | Cassiers et al. | 252/62.1 L X |
| 3,542,681 | 11/1970 | Mutaffis | 252/62.1 L X |

*Primary Examiner*—Stephen C. Bentley
*Assistant Examiner*—Peter A. Nelson
*Attorney, Agent, or Firm*—A. W. Breiner

[57] ABSTRACT

A liquid toner composition comprising carrier liquid and toner particles for the development of electrostatic charge patterns is described wherein the said liquid comprises (1) a bivalent or trivalent metal salt of an oxyacid derived from phosphorus containing at least one organic residue and (2) one or more members selected from the group consisting of amines, polyurethans and alkylated polymers of a heterocyclic N-vinyl monomer. By means of the materials (1) and (2) the polarity of the toner particles can be controlled to obtain optimum image density and contrast. When carbon blacks are used as toner material it is possible to control the polarity to obtain either positive-working or negative-working toner compositions.

14 Claims, No Drawings

LIQUID ELECTROPHOTOGRAPHIC DEVELOPERS

The present invention relates to electrophotography, and more particularly to improvements in the development of electrostatic charge patterns and to liquid developers used therefor.

Known electrophotographic processes for producing visible images comprise the steps of electrostatically charging in the dark a photoconductive surface, imagewise exposing the said surface whereby the irradiated areas become discharged in accordance with the intensity of radiation thus forming a latent electrostatic image and developing the material to form a visible image by depositing on the image a finely divided electroscopic material known as "toner." The image thus developed may be fixed to the surface of the photoconductor or transferred to another surface and fixed thereon. Instead of forming the latent electrostatic image by the steps described above it is also possible to charge directly the photoconductive layer in image configuration.

In one type of electrophotography, the latent electrostatic image is developed or rendered visible by use of liquid developers comprising coloured toner particles suspended in an insulating carrier liquid, which should have a volume resistivity in excess of $10^9$ ohm.cm and a dielectric constant below 3. The suspended toner particles, usually finely divided pigments or dyes, are electrostatically charged and develop the latent image under influence of the charge of the latent electrostatic image.

In the prior art it is known to produce so-called positive and negative liquid developers. A positive developer contains toner particles which are attracted by negative electrostatic charges. A negative developer contains toner particles which are attracted by positive electrostatic charges, or which upon contact with a surface bearing latent image areas formed by negative electrostatic charges, are repelled by such negative charges and deposit onto the non-image areas. Electrophotographic coatings containing zinc oxide are generally charged negatively with the result that the latent image formed by exposure is negative in polarity. Thus, a positive developer can be applied to a zinc oxide layer containing a negative latent image to produce a facsimile reproduction of the original radiation pattern whereas a negative developer can be applied to such layer to produce a reversal reproduction of the original radiation pattern.

The polarity of the toner material with respect to the latent image to be developed is determined by the nature of the materials used in the preparation of the liquid developer and by so-called polarity control agents, which confer to the suspended toner particles either a negative or positive charge.

One of the main problems in producing images by electrophotography employing liquid developers is that it is difficult to produce high density images and to obtain a background free of any toner deposit. For example, toner particles such as carbon black may exhibit varying degrees of both positive and negative polarities at the same time in the carrier liquid producing deposits in those areas of the image that should not be toned during the development process. Also many liquid developers become unstable with age and the toner particles either reduce, lose or reverse their polarity after a certain time which results in reduced density and image contrast. High density images on backgrounds free from staining are especially difficult to achieve by reversal development using liquid developers with toner particles of negative polarity. Another problem is the tendency of the toner particles to settle and subsequent difficulty to resuspend them in the carrier liquid.

From British Patent No. 1,151,141 it is known to use in liquid electrophotographic developers, bivalent or trivalent metal salts of an oxyacid derived from phosphorus containing at least one organic residue. These metal salts promote dispersion of the pigment or dye particles in the carrier liquid and also confer a positive charge to pigments such as carbon black.

Liquid developers comprising toner particles of negative polarity can be obtained by addition of materials providing the negative-working characteristics for the liquid toner composition.

In Belgian Pat. No. 654,977 it has been described that polyurethans are suitable for this purpose e.g. DESMALKYD-RS-165 resin (trade name of Bayer) which is a polyurethanalkyd resin prepared from dehydrated ricinus oil, soja bean oil and a diisocyanate.

According to U.S. Pat. No. 3,542,681 alkylated polymers of heterocyclic N-vinyl monomers are particularly suitable for conferring a negative charge to toner particles. These polymeric materials are preferably materials obtained by alkylation of homopolymers or copolymers of a N-vinyl lactam monomer most preferably a N-vinyl pyrrolidone monomer with an $\alpha$-olefin containing from 2 to 2000 carbon atoms, or obtained by simultaneously polymerizing and alkylating a mixture containing a heterocyclic N-vinyl monomer, and an $\alpha$-olefin.

Further, it is known from Belgian Pat. No. 661,525 that amines e.g. aliphatic and alicyclic amines, the ARMEENS and DUOMEENS (trade names) of Armour and Company, polymeric amines and polyethoxylated aliphatic amines such as the ETHOMEENS (trade names) of Armour and Company, also have a negatively polarizing effect in liquid toner compositions.

It has now been found that by the combined use of (1) the metal salts of the above British Patent No. 1,151,141 with (2) polyurethans, alkylated polymers of heterocyclic N-vinyl monomers and/or amines of the type described in the Patents referred to above, in liquid toner compositions for the development of electrostatic charge patterns exceptional results can be obtained. With the above combination it is possible to control the polarity of the toner particles by adjusting the relative ratio of materials (1) and materials (2) so as to obtain upon development optimum image density and contrast. Upon storing or during use any change in polarity of the toner particles which results in differences in image density and contrast can be restored by appropriate adjustment of the ratio of materials (1) and materials (2). Moreover, by means of the above combination it is not only possible to obtain positive-working toner compositions yielding high density positive images free from deposition of toner on the background but also to obtain negative-working toner compositions which yield upon reversal development high density reversal images free from background staining. Toner compositions according to the present invention may sometimes, e.g. when carbon black is used as colouring agent, be controlled to be either positive-working or negative-working dependent on the relative ratio of materials (1) and materials (2).

The present invention thus provides a liquid composition for the development of electrostatic charge patterns comprising an electrically insulating carrier liquid having a volume resistivity of at least $10^9$ Ohm.cm and a dielectric constant of less than 3 and a pigment or colouring agent e.g. carbon black suspended in the carrier liquid, wherein the said liquid composition comprises dissolved in the carrier liquid (1) a bivalent or trivalent metal salt of an oxyacid derived from phosphorus containing at least one organic residue, (2) one or more members selected from the group consisting of amines, polyurethans and alkylated polymers of heterocyclic N-vinyl monomers.

As is described in the British Patent No. 1,151,141, the bivalent or trivalent metal salts of a phosphorus oxyacid are preferably bivalent or trivalent metal salts of:

a. a monoester or diester of an oxyacid derived from phosphorus,
b. an oxyacid derived from phosphorus and containing one or two organic radicals linked to the phosphorus atom by a carbon atom, or
c. an oxyacid derived from phosphorus and containing an ester group and an organic radical linked by a carbon atom to the phosphorus atom. The said organic radical can be aliphatic, cycloaliphatic or aromatic.

The salt comprises an organic residue e.g. organic radical(s) and/or ester group(s) rendering the salt substantially soluble in the electrically insulating carrier liquid. The organic residue preferably comprises a chain of at least 4 carbon atoms, most preferably from 10 to 18 carbon atoms, and such chain may be substituted and/or interrupted by hetero-atom(s), e.g., oxygen, sulphur, or nitrogen atom(s).

The solubility in the electrically insulating carrier liquid of the metal salts can be promoted by the presence of one or more organic radicals with branched structure, e.g., branched aliphatic radicals, such as a 2-butyl-octyl radical.

Excellent results are obtained where the metal of the metal salts is zinc. However, other salts may also be used for example magnesium salts, calcium salts, strontium salts, barium salts, iron salts, cobalt salts, nickel salts, copper salts, cadmium salts, aluminium salts and lead salts.

More details about these bivalent or trivalent metal salts, representative examples thereof and methods of preparing these salts can be found in the above British Patent which is incorporated herein by reference.

The materials (2) which are used in combination with the metal salts (1) should be substantially soluble in the developer.

They include polyurethans as described in Belgian Pat. No. 654,977 which is incorporated herein by reference e.g. reaction products of di- or polyisocyanates, e.g. DESMODUR L which is a trade name of Farbenfabriken Bayer A.G. for a polyisocyanate solution in ethyl acetate containing 75 percent of solids, with vegetable oils e.g. soya bean oil and dehydrated ricinus oil, which reaction products may be formed in situ in the liquid toner composition by addition of the oils and isocyanates to the liquid composition. Particularly suitable for the purpose of the present invention is DESMALKYD-RS-165 resin (trade name of Farbenfabriken Bayer AG) which is a polyurethan alkyd resin with a solids content of 60 percent prepared from dehydrated ricinus oil, soya bean oil and a polyisocyanate.

The materials (2) used in combination with the metal salts (1) in accordance with the present invention further include amines of the type described in Belgain Pat. No. 661,525, which is incorporated herein by reference. These amines include aliphatic and alicyclic amines e.g. hexyl amine, octyl amine, dodecyl amine, didodecyl amine, dilauryl amine, N,N'-tetramethylhexamethylene diamine, N-alkyl morpholines, the ARMEENS and DUOMEENS (registered trade marks) of Armour and Company for example ARMEEN DMSD, a tertiary dimethyl soya amine and Duomeen 12 which is N-lauryl propylene diamine, polyethoxylated aliphatic amines e.g. those available from Armour and Company as ETHOMEENS and ETHODUOMEENS (registered trade marks) as well as organic esters thereof, soya been LECITHINE (marketed by Archer Daniels Midland Company USA) and polymeric amines.

Alkylated polymers of heterocyclic N-vinyl monomers as described in U.S. Pat. No. 3,542,681 which is incorporated herein by reference were also found very suitable for use in accordance with the present invention in combination with bivalent or trivalent metal salts of phosphorus oxyacids as described above. The heterocyclic N-vinyl monomers are preferably N-vinyl lactam monomers, most preferably a N-vinylpyrrolidone or N-vinylpiperidone monomer. As is learned from the said U.S. Patent the alkylated polymers of the heterocyclic N-vinyl monomers suitable for use in accordance with the present invention can be prepared by alkylation of a homopolymer or copolymer of such heterocyclic N-vinyl monomer with an alpha-olefin containing from 2 carbon atoms to 2000 carbon atoms, preferably in the range of from 2 to 200 carbon atoms, and most preferably in the range of from 8 to 42 carbon atoms, said alkylation process being more fully described in U.S. Pat. No. 3,417,054, or by simultaneously polymerizing and alkylating a mixture containing a heterocyclic N-vinyl monomer, and an alpha-olefin containing from 2 carbon atoms to 2000 carbon atoms or a mixture of the same or two different heterocyclic N-vinyl monomers and an alpha-olefin containing from 2 carbon atoms to 2000 carbon atoms, said simultaneous polymerization and alkylation process being more fully described in U.S. Pat. No. 3,423,367.

Representative examples of heterocyclic N-vinyl monomers, the alkylated polymer derivatives of which can be used in accordance with the present invention can be found in the above U.S. Pat. No. 3,542,681 which also includes representative examples of monoethylenically unsaturated polymerizable monomers suitable for copolymerization with the said heterocyclic N-vinyl monomers to form copolymers which are readily alkylated as described above. More details as regards the $\alpha$-olefins employed for producing the alkylated polymers can also be found in the said U.S. Pat. No. 3,542,681. It can also be learned from this U.S. Patent that the alkylated polymers have a K-value comprised between 10 and 140, preferably between 30 and 100.

Particularly suitable for use in accordance with the present invention are GANEX 216, GANEX 220 and ANTARON V216 which are olefin-alkylated polyvinylpyrrolidones with 20 percent vinyl pyrrolidone residue commercially available from GAF.

The liquid developer composition of the present invention comprises as a base fluid any of the conventional electrically insulating carrier liquids generally employed in liquid developer compositions. Thus, for example the carrier liquid includes various hydrocarbon solvents; e.g. aromatic hydrocarbons such as benzene, toluene and xylenes, aliphatic hydrocarbons such as hexane, cyclohexane and heptane; fluorocarbons and silicone oils. The carrier liquid is preferably a commercial petroleum distillate e.g. mixtures of aliphatic hydrocarbons preferably having a boiling point comprised between 150°C and 220°C such as the ISOPARS G, H, K and L (trade names) of the Esso Standard Oil Company, SHELLSOL T (trade name) of the Shell Oil company, etc.

The pigment or colouring agent used as toner may be any of the pigments and dyestuffs commonly employed in liquid electrostatic toner compositions. Thus, for example, the colouring agent or pigment can be carbon black and various analogous forms thereof e.g. lamp black, channel black and furnace black or coloured pigments including azo dyes, xanthene dyes, phthalocyanine dyes, which may be in X-form e.g. as described in published German Patent Application (DOS) No. 2,944,021, triphenyl methane dyes, diphenyl methane dyes, stilbene dyes, acridine dyes, quinoline dyes, quinoneimine dyes, thiazine dyes, azine dyes etc. When using carbon blacks as colouring matter it is possible in accordance with the present invention to provide at will either a positive-working liquid developer or a negative-working liquid developer dependent on the relative ratio of the above metal salts (1) and the materials (2).

Fixing agents may be added to the liquid electrostatic developing composition of the invention. As fixing substances normally resins are used and as is known in the art these resins should be highly compatible with the binder material of the photoconductive material e.g. the binder of the photoconductive zinc oxide layer, so that upon development it has a firm adhesion thereto in such a way that the final image does not tend to come loose from the support material. Examples of suitable resins are esters of hydrogenated rosin and "long-oil," rosin-modified phenol-formaldehyde resin, pentaerythritol ester of rosin, glycerin ester of hydrogenated rosin, ethyl cellulose, various alkyd resins, polyacrylic and polymethacrylic resin, polystyrene, polyketone resin and polyvinyl acetate. More specific examples of such resins can be found in the literature concerning liquid electrophotographic toner compositions e.g. in Belgian Pat. No. 699,157 and in British Patent No. 1,151,141.

In accordance with the present invention, the manner by which the liquid toner composition is produced is in no way critical and, accordingly, such composition can be prepared by conventional methods well known in the art. It is conventional to prepare by means of suitable mixers e.g. a 3-roll mill, ball mill, colloid mills, high speed stirrers, etc. a concentrate in the insulating carrier liquid of the materials selected for the composition and subsequently adding further insulating carrier liquid to provide the liquid toner composition ready for use in the electrostatic reproduction process.

The pigment or colouring agent e.g. carbon black is employed in the liquid developing composition ready for use in that amount necessary to be capable of being deposited when attracted to the electrostatic image, so that the desired image density is reached. Generally, the pigment or colouring agent is used in an amount comprised between about 0.01 g and 10 g per liter, preferably between about 0.01 g to about 2 g per liter.

While both the materials (1) and (2) referred to above must be present and should be in solution in the developing liquid, the amounts thereof are not critical if used in effective quantities, provided amounts are used which do not lower the volume resistivity of the resulting composition below $10^9$ Ohm.cm or raise the dielectric constant above 3. The quantity of materials (1) and (2) will vary with the nature of the charge already on the pigment or colouring agent and with the desired effect. As already noted above it is possible by controlling the relative ratio of materials (1) and (2) to control the polarity of the toner particles so as to obtain optimum image density and contrast. With some pigments e.g. carbon black it is possible to obtain either a negative-working or positive-working electrophotographic developing liquid. An individual determination of the required quantity of materials (1) and (2) may be made for each new combination by some simple experiments. Generally, the total amount of materials (1) and (2) is comprised between about 0.1 and about 10 percent by weight relative to the weight of pigment or colouring agent.

The following examples illustrate the present invention.

EXAMPLE 1

The following ingredients were ground in a ball mill for 12 hours:

12 g of a 25 percent by weight solution of NEOCRYL B 702 (trade name for a copolymer of butylmethacrylate and stearyl methacrylate comprising about 1 percent of methacrylid acid marketed by Polyvinylchemie, the Netherlands) in ISOPAR G (trade name for an aliphatic hydrocarbon solvent having a boiling range of 160°–175°C and a KB value of 27 marketed by the Esso Standard Oil Company)

2 g of carbon black (MM 2745 marketed by Arichemie, W. Germany)

10 ml of a 0.2 % (g/vol) solution in ISOPAR G of the zinc salt of mono-2-butyloctyl phosphate, and 25 ml of ISOPAR G.

From the above concentrated liquid toner composition 4 ml was diluted with 1 liter of ISOPAR G to form a positive-working electrophotographic liquid developer A. Another 4 ml was diluted with 1 liter of ISOPAR G whereupon 0.5 ml of a 2 %(g/vol) solution of didodecylamine in ISOPAR G was added to form a positive-working electrophotographic liquid developer B.

When used for the development of a latent electrostatic image formed on a conventional electrophotographic recording element comprising paper coated with photoconductive zinc oxide in a resinous binder by negative charging and image-wise exposure to light, it was found that developer B yielded an image of higher density and better contrast than that obtained with developer A.

EXAMPLE 2

The following ingredients were ground in a ball mill for 12 hours:

12 g of a 25 percent by weight solution of NEOCRYL B 702 in ISOPAR G,
2 g of carbon black (PRINTEX G marketed by Degussa A.G. W. Germany)
25 ml of ISOPAR G, and
varying amounts as listed in the table below, of 0.2 percent (g/vol) solutions in ISOPAR G of the zinc salt of mono-2-butyloctyl phosphate and of dodecylamine respectively.

| Composition | A | B | C | D |
|---|---|---|---|---|
| Zn-salt | 5 ml | 2 ml | 10 ml | 13 ml |
| dodecylamine | 10 ml | 13 ml | 5 ml | 2 ml |

10 ml of the concentrated liquid toner compositions formed, were diluted with 1 liter of ISOPAR G to form electrophotographic liquid developers ready for use.

When used for the development of latent electrostatic images formed as described in example 1 it was found that the developers of compositions A and B were negatively-working, that the developer of composition D was positively-working and that the developer of composition C showed both negative and positive characteristics and thus was unsuitable for use.

Where with developer D an image of high density and contrast was obtained, developers A and B which are negative-working also yielded images of high density on a background free from toner deposit.

EXAMPLE 3

The following ingredients were ground in a ball mill for 12 hours:
12 g of a 25 percent by weight solution of ANTARON V216 (GAF) in ISOPAR G
2 g of carbon black (MM 2745 of Arichemie - W. Germany)
35 ml of ISOPAR G From the above concentrated liquid toner composition 10 ml was diluted with 1 liter of ISOPAR G to form a negative-working electrophotographic liquid developer A. Another 10 ml was diluted with 1 liter of ISOPAR G whereupon 10 ml of a 2 % solution (g/vol) of the zinc salt of mono-2-butyloctyl phosphate in Isopar G was added to form a negative-working electrophotographic liquid developer B.

When used for the development of a latent electrostatic image formed on a conventional electrophotographic recording element comprising paper coated with photoconductive zinc oxide in a resinous binder, by negative charging and image-wise exposure to light, it was found that developer B yielded a reversal image of higher density, better contrast, and less staining of the background than that obtained with developer A.

EXAMPLE 4

The following ingredients were ground in a ball mill for 12 hours:

12 g of a 25 percent by weight solution of NEOCRYL B702 in ISOPAR G.
2 g of carbon black (MM 2745 of Arichemie)
20–25 ml of ISOPAR G
10 ml of a 0.2 percent solution (g/vol) of the zinc salt of 2-butyl-octyl phosphate in ISOPAR G.
from 2 to 6 ml of a 0.2 percent solution (g/vol) of ANTARON V 216.

10 ml of the concentrated liquid toner compositions formed, were diluted with 1 liter of ISOPAR G to form electrophotographic liquid developers ready for use.

When used for the development of latent electrostatic images formed as described in example 1 it was found that the developers were all positive working and give images having a higher density and better contrast than those obtained with developers containing no ANTARON V216.

EXAMPLE 5

The following ingredients were ground in a ball mill for 12 hours:

12 g of a 25 percent by weight solution of NEOCRYL B702 in ISOPAR G
2 g of carbon black (PRINTEX G marketed by Degussa A.G.)
25 ml of ISOPAR G and
varying amounts as listed in the table below, of 0.2 percent (g/vol) solutions in ISOPAR G of the zinc salt of mono-2-butyloctyl phosphate and DESMALKYD-RS-165 respectively.

| Composition | A | B |
|---|---|---|
| Zn salt | 10 ml | 5 ml |
| Desmalkyd-RS-165 | — | 10 ml |

10 ml of the concentrated liquid toner compositions formed, were diluted with 1 liter of ISOPAR G to form electrophotographic liquid developers ready for use.

When used for the development of latent electrostatic images formed as described in Example 1 it was found that compositions A and B have a positive polarity.

Developer B gives a positive image with higher density and better contrast than developer A.

EXAMPLE 6

The following ingredients were ground in a ball mill for 12 hours:

12 g of a 25 percent by weight solution of NEOCRYL B702 in ISOPAR G
2 g of carbon black(PRINTEX G of Degussa A.G.)
25 ml of ISOPAR G
10 ml of a 0.2 percent solution (g/vol) of the zinc salt of mono-2-butyl-octyl phosphate in ISOPAR G
from 2 to 6 ml of a 0.2 percent solution (g/vol) of the following amines:

developer A : DUOMEEN 12
B : ARMEEN O.M.S.O.
C : ARMEEN N.C.M.
D : ETHOMEEN 10 ml of the concentrated liquid toner compositions formed, were diluted with 1 liter of ISOPAR G to form electrophotographic liquid developers ready for use.

When used for the development of latent electrostatic images formed as described in example 1 it was found that the developers were all positive working and gave images having a higher density and better contrast than the developers containing no amine in addition to the zinc mono-2-butyl-octyl phosphate (see example 1 developer A).

We claim:

1. A liquid toner composition for the development of electrostatic charge patterns comprising an electrically insulating carrier liquid having a volume resistivity of at least $10^9$ Ohm.cm and a dielectric constant below 3, and a pigment or colouring agent suspended in the said carrier liquid, wherein the said liquid composition comprises dissolved in the carrier liquid(1) a bivalent or trivalent metal salt of an oxyacid derived from phosphorus containing at least one organic residue and (2) one or more members selected from the group consisting of amines, polyurethans and alkylated polymers of a heterocyclic N-vinyl monomer.

2. A liquid toner composition according to claim 1, wherein said oxyacid derived from phosphorus containing an organic residue is a monoester or diester of an oxyacid derived from phosphorus.

3. A liquid toner composition according to claim 1, wherein said oxyacid derived from phosphorus contains an organic residue having a chain of 10 to 18 carbon atoms.

4. A liquid toner composition according to claim 1, wherein said metal salt of an oxyacid derived from phosphorus is a zinc salt of mono-2-butyloctyl phosphate.

5. A liquid toner composition according to claim 1, wherein the said material designated (2) is an amine.

6. A liquid toner composition according to claim 5, wherein the amine is an aliphatic or alicyclic amine.

7. A liquid toner composition according to claim 6, wherein the amine is dodecylamine or didodecylamine.

8. A liquid toner composition according to claim 1, wherein the material designated (2) is a polyurethan.

9. A liquid toner composition according to claim 8, wherein said polyurethan is a polyurethan alkyd resin prepared from a vegatable oil with a polyisocyanate.

10. A liquid toner composition according to claim 1, wherein the material designated (2) is an alkylated polymer of a heterocyclic N-vinyl monomer.

11. A liquid toner composition according to claim 10, wherein said heterocyclic N-vinyl monomer is a N-vinyl lactam.

12. A liquid toner composition according to claim 11 wherein said N-vinyl lactam is a N-vinyl pyrrolidone.

13. A liquid toner composition according to claim 1, wherein the pigment or colouring agent is carbon black.

14. A liquid toner composition according to claim 1, wherein the carrier liquid is an aliphatic hydrocarbon.

* * * * *